United States Patent [19]

Zoor

[11] 4,296,615

[45] Oct. 27, 1981

[54] ANTI-THEFT ARRANGEMENT, PARTICULARLY FOR A MAST OF A SAILING CRAFT

[75] Inventor: Reinhold Zoor, Dachau, Fed. Rep. of Germany

[73] Assignee: Heinrich Wunder KG, Dachau, Fed. Rep. of Germany

[21] Appl. No.: 62,295

[22] Filed: Jul. 31, 1979

[30] Foreign Application Priority Data

Aug. 4, 1978 [DE] Fed. Rep. of Germany ..... 2834338

[51] Int. Cl.[3] ..... E05B 73/00

[52] U.S. Cl. ..... 70/19; 70/58; 70/181

[58] Field of Search ..... 70/19, 14, 57, 58, 181, 70/229, 232; 224/309, 322, 323, 324, 315; 211/4, 7, 8, 9

[56] References Cited

U.S. PATENT DOCUMENTS

| | | | |
|---|---|---|---|
| 2,807,398 | 9/1957 | Mathews | 224/323 |
| 2,846,864 | 8/1958 | Polston | 70/181 |
| 3,719,297 | 3/1973 | Nowicki | 224/315 |
| 3,926,018 | 12/1975 | Joersz | 70/19 |
| 3,970,196 | 7/1976 | Legge | 70/19 |

*Primary Examiner*—Robert L. Wolfe
*Attorney, Agent, or Firm*—Peter K. Kontler

[57] ABSTRACT

An anti-theft arrangement for rod-shaped objects, such as masts of sailing craft, includes a sleeve-shaped attachment and a clamping mechanism capable of clamping the attachment to a selected region of the rod-shaped object and to be locked in this operative position. The attachment, and with it also the object, is confined to a particular region of a support, such as a roof of a motor vehicle or a stationary part of a storage facility, either in that the attachment is situated intermediate two holding members each of which has a passage receiving and supporting object but having a diameter smaller than the largest transverse dimension of the attachment, or in that a chain or a similar elongated element is connected to the attachment and to the support and provided with a lock. The attachment may be of one-piece or may include two pivotally connected half shells connected with and pressed against one another by a buckle which is preferably fully received in a recess of the attachment in its closed position.

16 Claims, 4 Drawing Figures

Fig.1
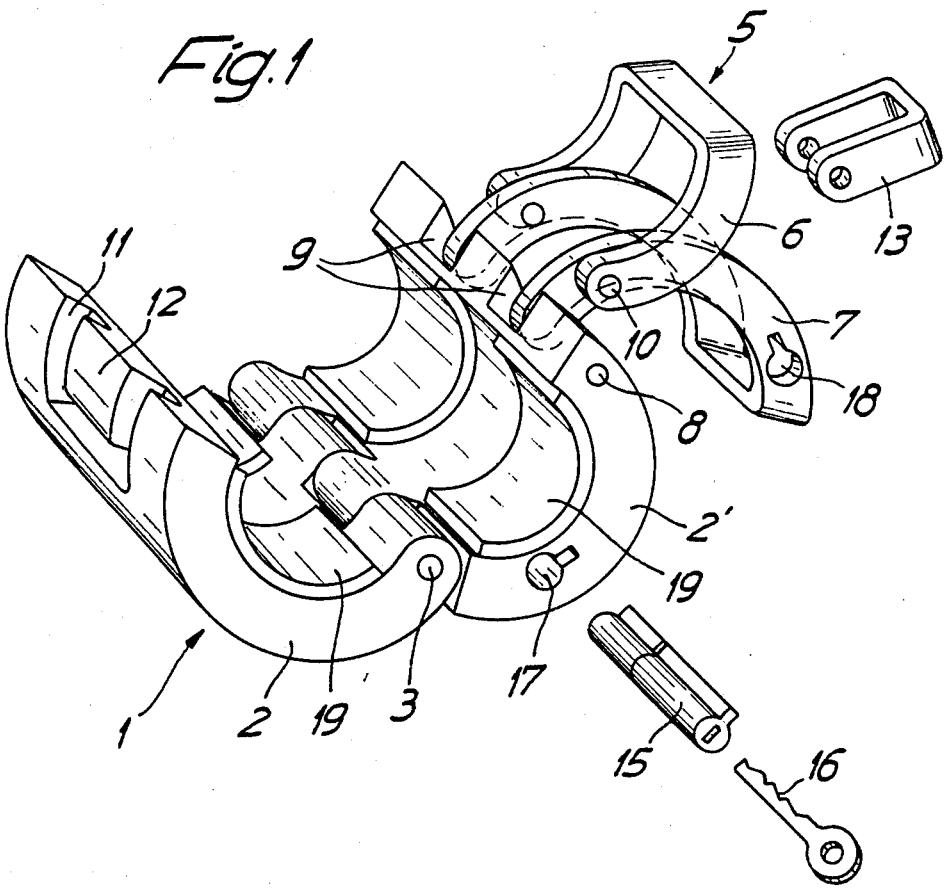
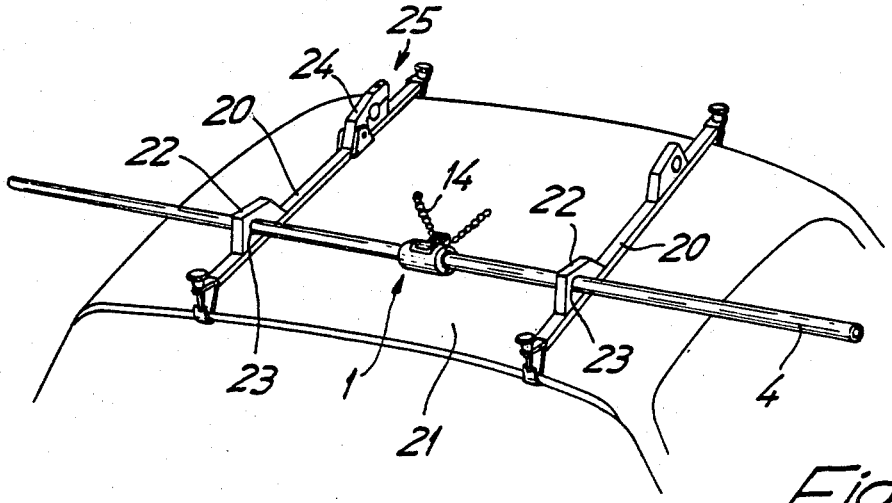
Fig.2

ANTI-THEFT ARRANGEMENT, PARTICULARLY FOR A MAST OF A SAILING CRAFT

BACKGROUND OF THE INVENTION

The present invention relates to anti-theft arrangements in general, and more particularly to an arrangement for preventing unauthorized removal of a rod-shaped object, particularly of a mast of a sailing craft, from a support.

It was heretofore impossible to prevent rod-shaped objects, which may have to be transported on the roof of a motor vehicle or stored in a hallway, a garage or a similar storing facility, from being stolen, in the event that it is impossible, for one reason or another, to provide each of these objects with a bore or an eyelet rigidly connected thereto and serving the purpose of connecting a locking device thereto. This is particularly true for masts of sailing or surfing boards which are both transported and stored separately from these boards.

OBJECTS AND SUMMARY OF THE INVENTION

It is a general object of the present invention to avoid the above-discussed disadvantage of the prior art.

More particularly, it is an object of the present invention to provide an anti-theft arrangement for a rod-shaped object, especially for a mast of a sailing craft.

A further object of the invention is to so construct the anti-theft arrangement as to be able to protect the object against theft without changing the object, that is without the provision of any bores in or any eyelet or similar member on the object.

A concomitant object of the invention is to develop an anti-theft arrangement of the type here under consideration which is simple in construction, inexpensive to manufacture, easy to operate and reliable nevertheless, while not causing any damage to the protected object even after repeated use.

In pursuance of these objects and others which will become apparent hereafter, one feature of the present invention resides in an arrangement for preventing unauthorized removal of a rod-shaped object, particularly of a mast of a sailing craft, from a support, which, briefly stated, comprises an attachment juxtaposed with the object in an operative position thereof; means for clamping the attachment to the object in the operative position; means for locking the clamping means at least in the operative position; and means for confining the attachment to a particular area of the support.

An important concept of the present invention is to be seen in the fact that the rod-shaped object, for instance a mast, is provided with an attachment which is clamped on the rod-shaped object in its operative position and which is locked in this operative position by means of a lock or the like so that unauthorized persons cannot remove the attachment from the object. In this context, it is to be mentioned that the attachment is so rigidly connected to the rod-shaped object by the action of the clamping means that the attachment cannot be removed from the rod-shaped object by sliding the same longitudinally of the object. In its operative and clamped position, the attachment constitutes an enlarged portion of the smooth rod-shaped object and thus prevents removal of the object out of a holding arrangement for the object. So, for instance, the rod-shaped object can be held on carrying brackets or on luggage rack of motor vehicles by means of two holding members, wherein the positioning of the anti-theft arrangement of the present invention between the two holding members, with the rod-shaped object supported in the holding members, renders it impossible to pull the rod-shaped object out of the holding members, whether the holding members are equipped with lockable buckles or only with passages for introducing the rod-shaped object, such as a mast, thereinto in its longitudinal direction, so long as the passages in the holding members are so defined as to render removal of the rod-shaped object from the holding members in any other direction than either longitudinally of the object or transversely of the elongation thereof upon release of the buckles impossible.

However, it is also possible to provide the attachment with an eyelet or the like which is rigid with the attachment and provided with an aperture into which a chain or a rope or a cable can be introduced in order to connect the attachment and, as a consequence thereof, also the rod-shaped object, to the luggage rack of a motor vehicle or, in the event of storage in a garage or a similar storage facility, to a wall hook, a pillar or another permanent structure available in the storage facility.

In the event that the rod-shaped object has a pressure-sensitive surface or that it is so smooth that a clamping action is impossible without damaging the surface, it is advantageous if, according to a further aspect of the present invention, a deformable body is interposed between the rod-shaped object and the attachment. Under these circumstances, the deformable body can either be a loose component accommodated on the rod-shaped object separately from the attachment, such as an O-ring or a plurality of such or similar rings, or the deformable body can be arranged on the attachment and, for instance, form an elastically compressible layer. In order to be able to use the attachment in conjunction with the rod-shaped object having different diameters, it is advantageous when the deformable body is constituted by an interchangeable insert. As a result of this feature, it is also possible to effectively grip conically shaped rod-like objects, inasmuch as either the elastically deformable insert correspondingly yields, or different inserts can be used at the two longitudinal ends of the attachment, in order to compensate for the difference in diameter which is caused by the conical configuration of the rod-shaped object.

The attachment can be constructed as a clamping ring or sleeve which is substantially correlated as to its shape to the cross section of the rod-shaped object. The attachment can be made of one-piece of a rigid material and can be provided with a lockable clamping screw which is arranged substantially normal to the longitudinal axis of the rod-shaped object to be received within the attachment and which passes through the attachment and cooperates with the rod-shaped object. In accordance with another feature of the present invention, the attachment can either be made of one piece so that it is necessary that the attachment be compressible at least in a portion thereof in order to achieve a clamping action, or the attachment can be split or slotted generally in its longitudinal direction and be elastically deformable in order to be able to achieve the clamping action by compression. However, it is also possible to split the attachment all the way across so that there are obtained two half shells which are connected to one another by means of a hinge and which can be displaced toward each other by an appropriate displacing device for clamping the object therebetween.

The clamping means can include a strap surrounding the attachment, and means for tensioning the strap, particularly a rapid-engagement toggle-lever buckle. However, it is also conceivable and proposed by the present invention to construct the clamping means in the manner of a hose clamp.

In one currently preferred embodiment of the present invention, the clamping means includes a toggle-lever buckle mounted on the attachment. It is advantageous when the attachment is of a rigid material, such as metal or hard synthetic plastic material and when it has a recess which fully accommodates the buckle in a clamping position of the latter. Under these circumstances, it is especially advantageous when the attachment is provided with a substantially longitudinal bore, and when the locking means includes a locking cylinder received in the bore and arresting the buckle in its clamping position at least in the operative position of the attachment. The provision of the locking arrangement of this type, combined with the countersunk reception of the buckle within the recess, renders it all but impossible for an unauthorized person to open the attachment.

When the buckle-type toggle-lever arrangement is made of flat steel or iron bars and the bars are so oriented relative to the attachment that their major surfaces extend substantially normal to the longitudinal axis of the attachment, there is obtained an extremely narrow recess for the reception of the buckle-type toggle lever arrangement in the attachment, this recess being completely filled with the flat material of the buckle-type closing arrangement. As a result of this, it is impossible to bend the toggle-lever closing arrangement, for instance by a screwdriver, out of its receiving recess in order to subsequently saw therethrough.

The novel features which are considered as characteristic of the invention are set forth in particular in the appended claims. The improved invention itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a perspective view of an anti-theft arrangement of the present invention;

FIG. 2 is a perspective view illustrating how an anti-theft arrangement of the present invention can be mounted on a mast or a similar rod-shaped object which is supported in holding members on the roof of a motor vehicle;

DESCRIPTION OF THE PREFERRED EMBODIMENTS

Figure 3:
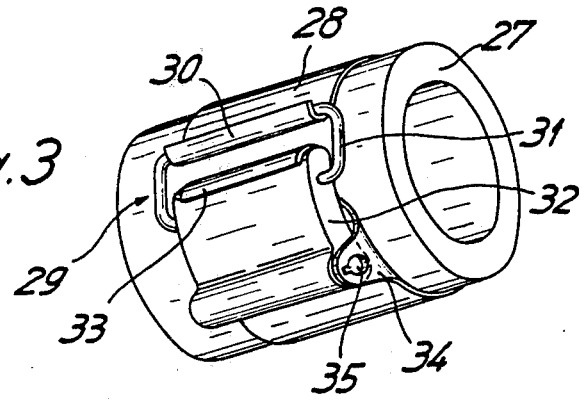
FIG. 3 is a perspective view similar to FIG. 1 but of a modified anti-theft arrangement of the present invention.

Referring now to the drawing, and first to FIG. 1 thereof, it may be seen that the reference numeral 1 has been used to designate an anti-theft arrangement for rod-shaped objects in its totality. The anti-theft arrangement 1 is constructed as an attachment to a rod-shaped object (compare FIG. 2). As shown in FIG. 1, the attachment 1 includes two half shells 2 and 2' which are connected to one another by means of a hinge 3. In this manner, the two parts or half shells 2 and 2', each of which constitutes a half of the attachment 1 in the illustrated example, can be pivoted relative to one another about the hinge 3 so that the attachment 1 can be opened, positioned on the rod-shaped object 4, such as a mast, and closed again.

A toggle-lever buckle 5 serves for mutual tensioning of the two shell parts 2 and 2'. The buckle 5 incorporates an engaging bracket 6 and a closing bracket 7. The closing bracket 7 which, like also the engaging bracket 6, has a U-shaped configuration and is accommodated to the curved circumferential surface of the attachment 1 is pivotally mounted at its free ends, by means of pivots 8, in a recess 9 having a configuration coordinated to that of the closing bracket 7. The free ends of the engaging bracket 6 are articulated to the closing bracket 7 by pivots 10 which are so arranged that, in the closed condition of the toggle-lever buckle 5, they are located more radially inwardly than the pivots 8 so that there is obtained an over-dead-center holding action. In the closed position of the toggle-lever buckle 5, the engaging bracket 7 is partially received in the recess 9 of the shell half 2', while the remainder of the engaging bracket 7 is received in a recess 11 provided in the shell half 2, the recess 11 being accommodated as to its configuration to that of the above-mentioned remainder of the engaging bracket 6. In view of the fact that the shape of the recess 11 is fitted to that of the U-shaped engaging bracket 6, there is formed a protrusion 12 which is engaged by the engaging bracket 6, which engagement forces the two shell halves or parts 2 and 2' toward one another during and upon closing of the toggle-lever buckle 5 by means of the closing bracket 7. In the closed position, all parts or components of the toggle-lever buckle 5 are accommodated within the recesses 9 and 11 and they are flush with the circumferential surface of the shell halves 2 and 2'. A further bracket 13, which is also of a U-shaped configuration, can have its free ends also connected to the pivots 10, so that the further bracket 13 extends beyond the circumferential surface of the attachment 1 in the closed position of the toggle-lever buckle 5, thus forming an attachment eyelet or aperture for a chain 14 or a similar elongated element, as indicated in FIG. 2. The attachment 1 which consists of the shell halves 2 and 2' can be connected by means of this chain 14 to any selected stationary object, such as a wall hook, by means of a padlock or the like.

A cylinder lock 15 serves for securing the closing bracket 7 in its closed position. The cylinder lock 15 can be inserted into a shape-coordinated bore 17 from one of the end faces of the shell half 2' in the axial direction of the attachment 1, by means of a key 16 inserted thereinto. Once inserted, the cylinder lock 15 engages the closing bracket 7 so that the latter is arrested by the cylinder lock 15 in its closed position after the withdrawal of the key 16.

In order to assure that the attachment 1 consisting of the shell halves 2 and 2' remains fixed as to its position on the rod-shaped object 4, such as a mast, which has a smooth surface, elastic inserts 19, for instance consisting of rubber or synthetic plastic material, are provided at the inner side of the shell halves 2 and 2'. These inserts 19 are compressed during and subsequent to the displacement of the shell halves 2 and 2' by means of the toggle-lever buckle 5 into the clamping position of the attachment 1, and thus bring about a sufficiently positive force-transmitting connection between the attachment 1 and the object 4, which connection is so strong that the attachment 1 cannot be shifted longitudinally of the rod-shaped object or mast 4 without opening the toggle-lever buckle 5. This is true even when the rod-shaped object 4 has a slight conicity, as is the case in a mast for a surfing board or the like. More particularly, the inserts 9 can be compressed to such an extent that the slight conicity can be compensated for in this manner so that a secure clamping engagement of the attachment 1, via the inserts 19, with the object or mast 4 is achieved.

FIG. 2 illustrates in more detail the mounting of a mast 4 on carrier brackets 20. As shown, the carrier brackets 20 are permanently situated at the roof of a motor vehicle or the like. For supporting and holding the mast 4, the carrying brackets 20 are either provided with holding members 22 which are provided with passages 23 for sliding the mast 4 (but not the attachment 1) therethrough in the longitudinal direction of the mast 4, or they can be provided with holding members 25 equipped with lockable closing buckles 24 so that the mast 4 can be lifted out of the holding members 25 upon the opening of the lockable closing bracket 24. In this manner, it is not necessary to slide the mast 4 through the passages 23 as it is necessary when the holding members 22 are of one-piece. Now, when the attachment 1 is clamped onto the mast 4, particularly on a region of the latter which is situated intermediate the two associated holding members 22 or 25 supporting the mast 4, the mast 4 can no longer be pulled out of the holding members 22 or 25. When it is assured that the holding members 22 or 25 cannot be opened or destroyed in a simple manner, it is almost impossible for an unauthorized person to remove the mast 4 from the carrying brackets 20.

An attachment in the form of a sleeve 27 is illustrated in FIG. 3. The sleeve 27 is made of a compressible material and it can be slid onto a rod-shaped object 4, for instance a mast, which is to be protected against theft. In order to obtain the necessary clamping action, there is provided a strap 28 which can be tensioned by means of a toggle-lever buckle 29. To achieve this, the strap 28 is formed with a bent end portion 30 which is engaged by an engaging bracket 31 which is pivotally supported on a tensioning bracket 32 that is pivotally supported on the opposite end 33 of the strap 28. The strap 28 is provided with an upwardly bent lug 34 at a region of the end of the tensioning bracket 32 in its closed position. The lug is provided with a bore 35 into which a locking cylinder can be introduced in a manner similar to that discussed in connection with the introduction of the cylinder lock 15 in the closing arrangement of FIG. 1. In this manner, opening of the tensioning bracket 32 and thus of the entire toggle-lever buckle 29 is prevented.

Figure 4:
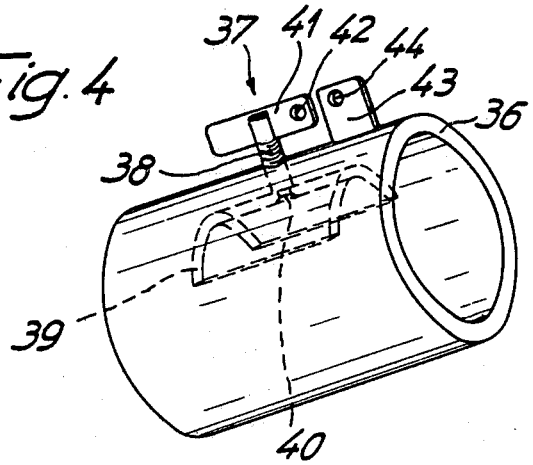
FIG. 4 is a view similar to that of FIG. 3 but of yet another modification.

FIG. 4 illustrates a sleeve 36 made of a rigid synthetic plastic material or metal which is also usable as the above-discussed anti-theft arrangement. The sleeve 36 is equipped with a clamping arrangement 37 which includes a clamping screw 38 and a clamping plate 39. The clamping plate 39 is rotatably but non-shiftably supported on the end of the clamping screw 38 which penetrates into the interior of the sleeve 36. When the clamping screw 38 is threaded into an internal thread provided in the wall of the sleeve 36, the clamping plate 36 is pressed against the rod-shaped object 4 (compare FIG. 2). In order to prevent an unauthorized loosening of the clamping screw 38 and an intended disengagement of the clamping plate 39 from the object 4, the clamping screw 38 has a bore 42 in a wing 41. A lug 43 having a bore 44 is rigidly connected to the sleeve 36 adjacent to the trajectory of movement of the wing 41 so that, in the illustrated position of the screw 38, a padlock or a similar lock can be passed through the bores 42 and 44 and locked to arrest the wing 41 and thus the entire clamping screw 37 in the illustrated clamping position.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. An arrangement for preventing unauthorized removal of a rod-shaped object, particularly a mast of a sailing or similar craft, from a support, comprising an annular attachment in the form of a sleeve consisting of a rigid material and configurated to substantially fittingly embrace a region of the object when in operative position; at least one screw meshing with and penetrating into the interior of said sleeve for clampingly engaging said region of the object; means for locking said screw, at least in said operative position of said attachment; and means for confining said attachment to a particular area of the support.

2. An arrangement for preventing unauthorized removal of a rod-shaped object, particularly a mast of a sailing or similar craft, from a support, comprising an annular attachment including two pivotally connected half-shells together adapted to substantially fittingly embrace a region of the object when the attachment is in operative position; clamping means for clamping said attachment to the object in said operative position of said attachment, including means for displacing said half-shells toward each other so as to clamp said region of the object therebetween; means for locking said clamping means, at least in said operative position of said attachment; and means for confining said attachment to a particular area of the support.

3. An arrangement for preventing unauthorized removal of a rod-shaped object, particularly a mast of a sailing or similar craft, comprising an annular attachment configurated to substantially fittingly embrace a region of the object when in an operative position; means for clamping said attachment to the object in said operative position of said attachment, including a strap surrounding said attachment and means for tensioning said strap; means for locking said clamping means in the operative position of said attachment; and means for confining said attachment to a particular area of the support.

4. An arrangement for preventing unauthorized removal of a rod-shaped object, particularly a mast of a sailing or similar craft, from a support, comprising an annular attachment configurated to substantially fittingly embrace an object when in an operative position; means for clamping said attachment to the object in said operative position of the attachment, including a toggle-lever buckle mounted on said attachment; means for locking said clamping means, at least in the operative position of said attachment; and means for confining said attachment to a particular area of the support.

5. An arrangement for preventing unauthorized removal of a rod-shaped object, particularly a mast of a sailing or similar craft, from a support, comprising an attachment juxtaposed with the object when in an operative position; means for clamping said attachment to the object in the operative position of said attachment; means for locking said clamping means, at least in the operative position of said attachment; and means for confining said attachment to a particular area of the support, including two holding members rigid with the support and each having a passage for receiving a zone of the object and having a passage diameter at least equal to that of the respective zone but smaller than the largest radial dimension of said attachment, said attachment being disposed intermediate said holding members when said zones are received in said passages.

6. An arrangement as defined in claim 2; and further comprising deformable means interposed between the object and said attachment at least in said operative position.

7. An arrangement as defined in claim 6, wherein said deformable means is connected to said attachment.

8. An arrangement as defined in claim 6, wherein said deformable means is constituted by at least one exchangeable insert.

9. An arrangement as defined in claim 3, wherein said attachment is a sleeve of a compressible material and said clamping means further includes means for pressing at least a portion of said sleeve against said region of the object.

10. An arrangement as defined in claim 9, wherein said attachment is a slotted sleeve and said clamping means includes means for elastically deforming said sleeve into clamping engagement with said region of the object.

11. An arrangement as defined in claim 3, wherein said tensioning means includes a rapid-engagement toggle-lever buckle.

12. An arrangement as defined in claim 4, wherein said attachment is of a rigid material and has a recess fully accommodating said buckle in a clamping position of the latter.

13. An arrangement as defined in claim 12, wherein said attachment has a substantially longitudinal bore; and wherein said locking means includes a locking cylinder received in said bore and arresting said buckle in its clamping position at least in said operative position of said attachment.

14. An arrangement as defined in claim 5, wherein at least one of said holding members includes a body and a lockable closing buckle pivotally mounted on said body and defining said passage therewith.

15. An arrangement as defined in claim 2, wherein said confining means includes an elongated element lockably attached to the support and to said attachment.

16. An arrangement as defined in claim 15, wherein said attachment includes an aperture for receiving a section of said elongated element.

* * * * *